United States Patent [19]

Braun et al.

[11] 4,340,185

[45] Jul. 20, 1982

[54] ROLL CRUSHER FOR CRUSHING LUMPY MATERIAL

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 131,127

[22] Filed: Mar. 17, 1980

[30] Foreign Application Priority Data

Mar. 31, 1979 [DE] Fed. Rep. of Germany ..... 2912979

[51] Int. Cl.[3] ..... B02C 13/286

[52] U.S. Cl. ..... 241/186 R; 241/187; 241/189 R; 241/190

[58] Field of Search ..... 241/186 R, 189 R, 190, 241/187; 198/728, 731, 850

[56] References Cited

U.S. PATENT DOCUMENTS 4,047,673 9/1977 Aulmann et al. ..... 241/186 R 4,061,398 12/1977 Parkes ..... 241/186 R X

*Primary Examiner*—Mark Rosenbaum

*Assistant Examiner*—Timothy V. Eley

*Attorney, Agent, or Firm*—McGlew and Tuttle

[57] ABSTRACT

A roll crusher for crushing lumpy material particularly coal and other minerals comprises a conveyor trough having a trough bottom with a plurality of longitudinally extending laterally spaced chains trained to run over the trough bottom and move through a path from beneath a crushing roller of the roll crusher. The crushing roller is rotatably mounted above the trough bottom and has a rotatable shaft portion with a plurality of radially extending axially spaced and angularly offset striker portions along its length. A plurality of pushers extend laterally between and interconnect adjacent strands so as to form a chain mat type structure of the conveyor which moves along the trough beneath the crusher roll. The chains are spaced laterally apart by spacing comprising a clearance selected to be equal to or less than the maximum grain size to be formed in the material by the crusher. The pushers are longitudinally spaced between adjacent chains and disposed in respect to the crusher rolls as the striking tools rotate through paths bringing the outer ends of the crushing tools between adjacent strands of the chain. The pushers are advantageously made of a height lower than the vertical links of the chains so that they form trough type recesses therebetween. The pusher height is advantageously made substantially equal to half the height of the vertical chain links. The pushers of adjacent strands are staggered preferably by the length of one vertical chain link.

8 Claims, 3 Drawing Figures

ROLL CRUSHER FOR CRUSHING LUMPY MATERIAL

FIELD AND BACKGROUND OF THE INVENTION

The invention relates in general to material crushing and in particular to a new and useful single roll crusher for crushing lumpy material, particularly coal and similar minerals, with a crusher roll and striking tools arranged on the crusher shaft, as well as a crusher plate spaced underneath the crusher roll, which is formed by the conveyor trough of a chain conveyor passing through the single-roll crusher.

A constant problem in crushing lumpy material in a single-roll crusher is that the material is obtained after the crushing in completely different grain sizes. Actually the grain size spectrum is relatively wide, because the material is partly not crushed between the striking tools and the crusher plate. This becomes a problem when the material is to be crushed to desired grain sizes which do not exceed a certain maximum size, and hence a given value. The crushing of the material must ensure a corresponding grain classification, to make elaborate resorting to obtain the desired grain sizes unnecessary, because such resorting is extremely costly and therefore disadvantageous. The invention is designed to remedy this situation.

SUMMARY OF THE INVENTION

The invention provides a single roll crusher which ensures crushing of the lumpy material down to the desired maximum grain size.

A single roll crusher according to the invention includes a chain conveyor with several chain strands, forming a chain mesh mat, which are joined with each other by means of pushers and are arranged in a grading interval whose clearance is equal to or less than the desired maximum grain size, and which are so aligned with regard to the path of revolution of the striking tools that the striking tools revolve centrally with regard to the chain strands and extend between the chain strands. These measures of the invention have the result that all fragments of the material to be crushed are gripped by the striking tools whose grain size exceeds the desired maximum grain size, because these fragments lie on the chain strands or at least exceed the height of the chain strands. Due to the fact that chain strands are spaced from each other in the grading interval, the lumpy material to be crushed can not yield transverse to the direction of conveyance. But it is also positively gripped by the striking tools in the direction of conveyance, because the speed of revolution of the crusher rool, and thus of the striking tools or their striking heads is a multiple of the chain speed, and thus of the conveying speed. The striking tools thus strike down the material several times while it runs under the crusher roll. This ensures adequate crushing of the lumpy material, so that finally only crushed material leaves the single roll crusher whose grain size does not exceed the maximum grain size defined by the grading interval between the chain strands. Since the striking tools rotate in centric alignment between the chain strands, the distance between the individual striking tools is necessarily smaller than the grading interval between the chain strands. In this respect too, no material can pass through or leave the crusher which exceeds the desired maximum grain size. As a result, the desired grading is obtained.

Thus, the invention provides that the pushers are lower in height than the vertical chain links in the range between the chain strands, forming a trough-type recess. Preferably, the height of the pushers corresponds to about half the height of the vertical chain links, so that the striking tools can penetrate deep between the chain strands without damaging the pushers. In this way, undesired formation of clods is prevented. In order to obtain an optimum conveyance effect, particularly on slopes, a pusher is connected, according to the invention, to every fourth chain link or every second horizontal chain link of adjacent chain strands and the pushers of all chain strands are staggered. In order to obtain the proper grain size for rubber conveyor belts, the invention finally provides that the clearance of the grading interval between the chain strands be selected with less than 200 mm.

The advantages achieved by the invention are seen substantially in that a single roll crusher is realized which ensures the crushing of lumpy material down to a maximum grain size so that no grain size is obtained that exceeds the given maximum grain size. Actually, the single-roll crusher according to the invention can be used for grading to the desired grain size by setting a corresponding grading interval between the chain strands forming a chain mesh mat. The alignment and spacing of the chain strands relative to the grading interval is effected by means of the pushers connecting the chain strands. The single-roll crusher according to the invention thus makes resorting of the crushed material unnecessary in a simple and functional matter.

Accordingly it is an object of the invention to provide a roll crusher for crushing lumpy material particularly coal and other minerals which comprises a conveyor trough having a trough bottom with a plurality of longitudinally extending laterally spaced chains trained to run over the trough bottom beneath a crushing roller which is rotatably mounted above the trough bottom and has a plurality of radially extending axially spaced striker portions along its length, said chain conveyor including a plurality of pushers extending laterally between and interconnecting adjacent strands so as to form a chain mat structure movable on said trough bottom beneath said crusher roll, said chains being spaced laterally apart by a spacing comprising a clearance selected to be equal or less than the maximum grain size to be formed in the material by the crusher and wherein the pushers are longitudinally spaced between adjacent chains and disposed in respect to said crusher roll so that the striking tools rotate through paths bringing their outer ends between adjacent chains.

A further object of the invention is to provide a roll crusher which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF PREFERRED EMBODIMENT

Figure 1:
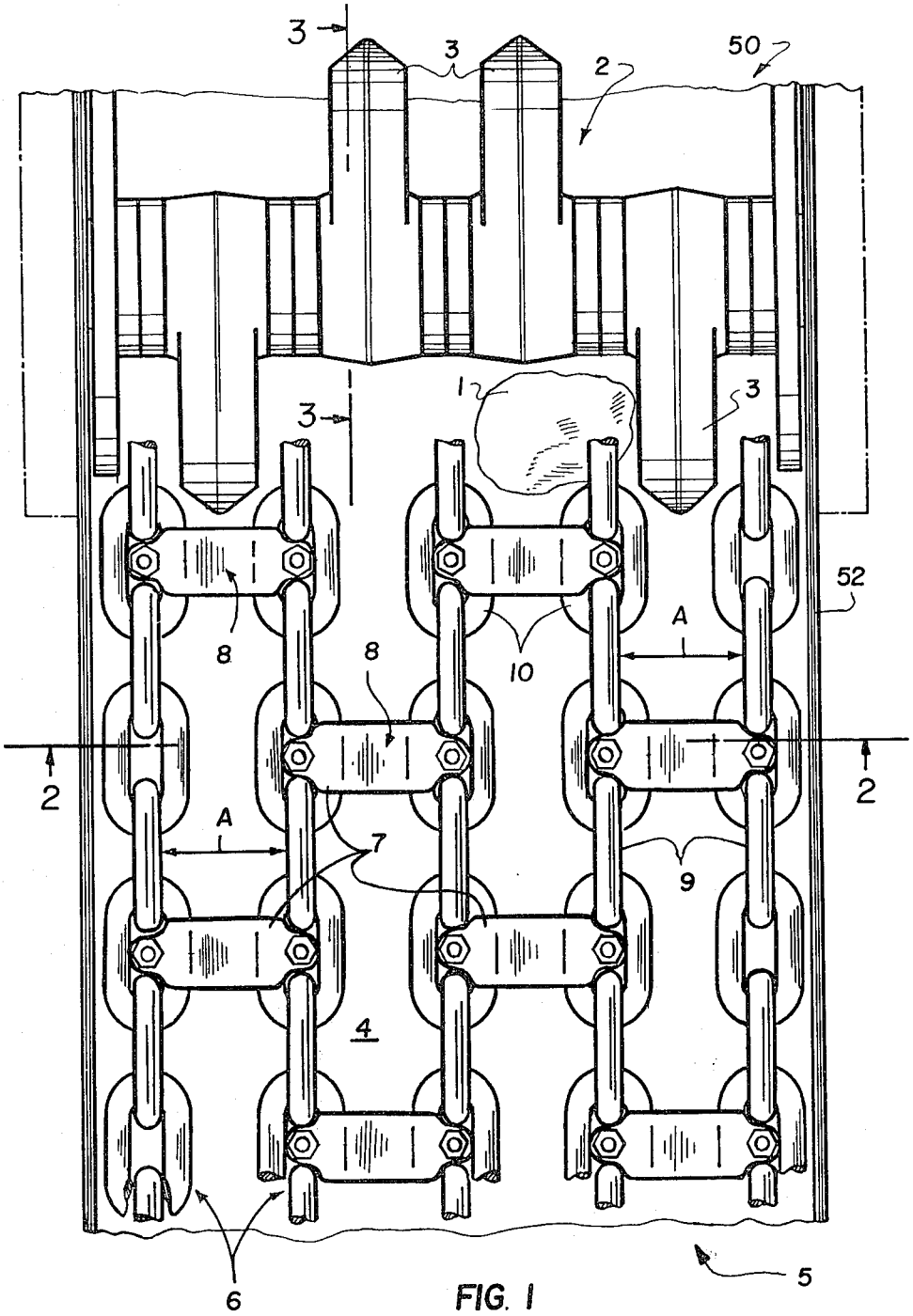
FIG. 1 is a partial top plan view of a roll crusher constructed in accordance with the invention.
Figure 2:
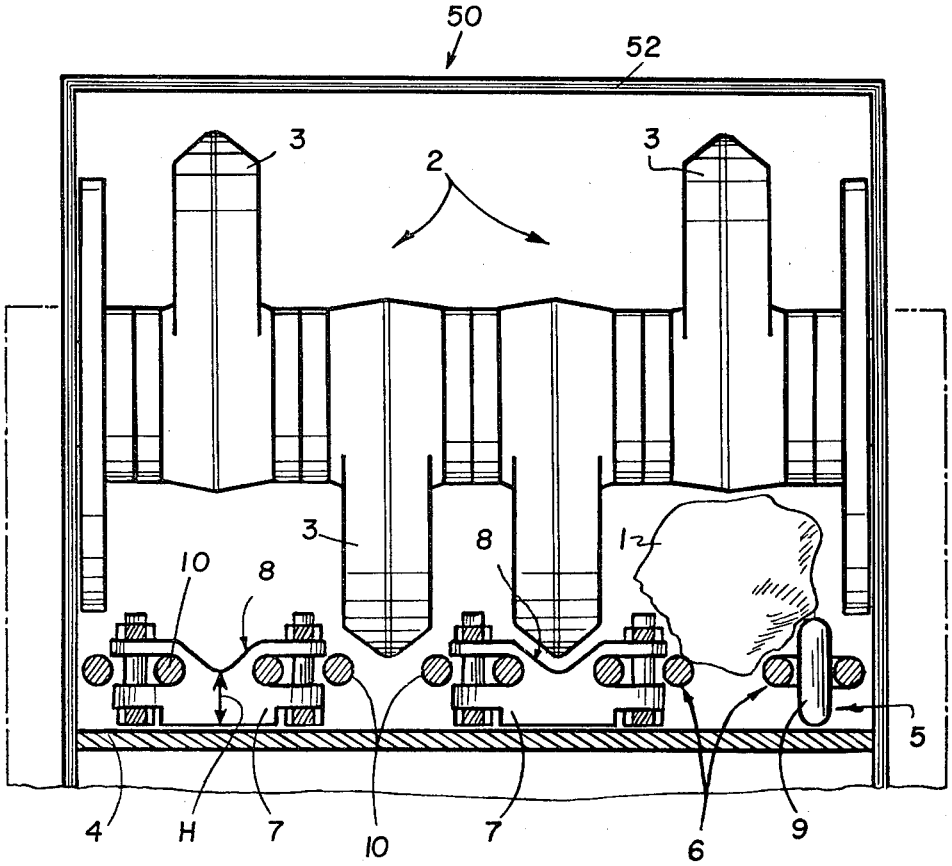
FIG. 2 is a vertical section taken along the line 2—2 of FIG. 1.
Figure 3:
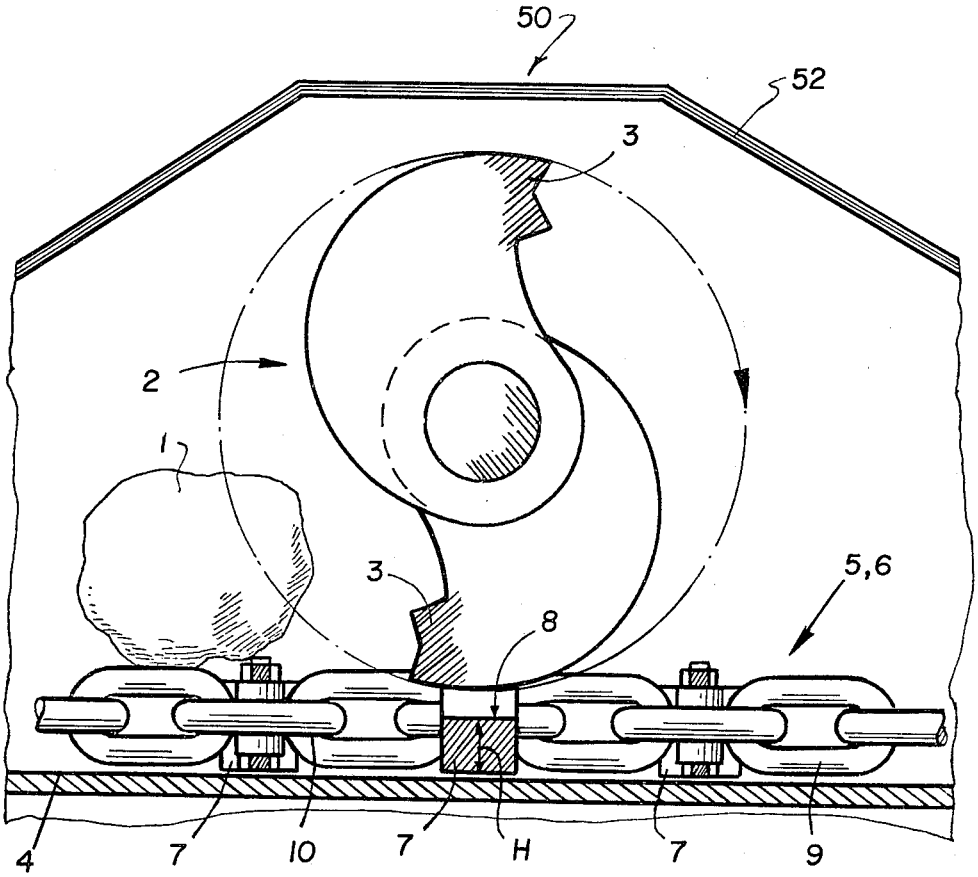
FIG. 3 is a vertical section taken along the line 3—3 of FIG. 1.

Referring to the drawings in particular, the invention embodied therein comprises a crusher generally designated 50 which includes a combined crusher and conveyor housing 52 in which is rotatably mounted a crusher roll generally designated 2 which is disposed over a trough bottom 4 which also forms a bottom wall of the housing 52 and which is located below the roll 2 which is rotatably mounted in the housing.

The figures show a single-roll crusher for crushing lumpy material 1, particularly coal and similar minerals. This single-roll crusher has a crusher roll 2 with striking tools 3 arranged angularly offset and axially spaced on the crusher shaft. Under striking tools 3 in a given distance or spacing, there is a crusher plate which is formed by a conveyor trough 4 of a chain conveyor 5 passing through a plane below crusher roll 2. The distance of conveyor trough 4 from crusher roll 2 corresponds to the height of passage for material 1 to be passed through and crushed. Chain conveyor 5 has several longitudinally extending chains or chain strands 6 forming, with drivers or pushers 7 that are attached to the chairs, a chain mesh mat 8 which fills the cross-section of conveyor trough 4. The chains 6 are connected with each other by the pushers 7. These chain strands 6 are arranged side by side in a lateral spacing or grading interval A, which is equal to or less than the desired maximum grain size. The chain strands 6 are so aligned with regard to the path of revolution of each of the striking tools 3, that the striking tools rotate centrically with regard to the chain strands 6 and extend between adjacent chain strands. Pushers 7 are lower in height H in the range between chain strands 6, forming a trough-type recess, than the height of vertical chain links 9 of each chain 6. Pusher height H corresponds substantially to half the height of vertical chain links 9. To every fourth vertical chain link, or every second horizontal chain link 10, of adjacent chain strands 6 is connected a pusher 7. Pushers 7 of all chain strands 6 are staggered by half the pusher interval of a pair of chain strands. In a special embodiment for the production of proper grain sizes for rubber conveyor belts, the clearance of the grading interval A between chain strands 6 is selected equal to or less than 200 mm.

While a specific embodiment of the invention has been shown and described in detail to illustrate the application of the principles of the invention, it will be understood that the invention may be embodied otherwise without departing from such principles.

What is claimed is:

1. A single-roll crusher for fragmenting coarse-grained material, particularly coal and other minerals, comprising a housing, a shaft mounted to said housing for rotation, striking tools mounted on said shaft for rotation therewith through a path of rotary motion, a conveyor trough having a crusher plate extended at a predetermined distance vertically below said striking tools, a chain mesh mat mounted intermediate said crusher plate and said striking tools, said chain mesh mat comprising a multiplicity of chain strands extending side by side and horizontally spaced from each other by a predetermined lateral distance not greater than a desired maximum grain size, and pushers connecting adjacent chain strand, each of said chain strands comprising interconnected links alternate ones of which are vertical and horizontal, said chain mesh mat being aligned with the path of rotary motion of respective striking tools so that the tools project and rotate centrally between adjacent chain strands, and each of said pushers having in the zone between adjacent chain strands a trough-like recess having a depth extending below the top of said vertical chain links.

2. A roll crusher according to claim 1, wherein said pushers having a height at least in a portion thereof extending between said chains of substantially half the height of said vertical chain links.

3. A roll crusher according to claim 1, wherein said pushers are connected to every fourth chain links of adjacent chains, said pushers of said chain strands being staggered by half the pusher interval of a pair of said chain strands.

4. A single roll crusher according to claim 1, wherein said chain strands are laterally spaced by a grading interval equal to less than 200 mm.

5. A chain conveyor according to claim 1, wherein said pushers are connected between and extending over laterally aligned horizontal links of adjacent chain strands.

6. A roll crusher according to claim 5, wherein said pushers have flat bottoms engageable on said crusher plate, each pusher including a pusher portion extending above ahd below the horizontal link associated therewith and a clamping bolt extending through the portion above and below said horizontal link and extending through said horizontal link to hold said pusher to said chain strands.

7. A roll crusher according to claim 5, wherein said striking tools on said shaft are angularly offset.

8. A crusher according to claim 5, wherein said striker tools are shaped to move through a path intersecting the recess of said pushers.

* * * * *